US009464437B1

(12) United States Patent
Al-Failkawi

(10) Patent No.: US 9,464,437 B1
(45) Date of Patent: Oct. 11, 2016

(54) PRECAST I-BEAM CONCRETE PANELS

(71) Applicant: Naji Mohammed Al-Failkawi, Kuwait (KW)

(72) Inventor: Naji Mohammed Al-Failkawi, Kuwait (KW)

( * ) Notice: Subject to any disclaimer, the term of this patent is extended or adjusted under 35 U.S.C. 154(b) by 0 days.

(21) Appl. No.: 14/964,570

(22) Filed: Dec. 9, 2015

(51) Int. Cl.

| | |
|---|---|
| ***E04B 5/04*** | (2006.01) |
| ***E04C 2/04*** | (2006.01) |
| ***E04C 3/294*** | (2006.01) |
| ***E04B 1/30*** | (2006.01) |
| ***E04C 5/06*** | (2006.01) |

(52) U.S. Cl.
CPC ..... *E04C 3/294* (2013.01); *E04B 1/30* (2013.01); *E04B 5/04* (2013.01); *E04C 5/0622* (2013.01)

(58) Field of Classification Search
CPC ..... E04B 1/30; E04B 5/04; E04B 5/29; E04C 3/293; E04C 3/294; E05C 5/0622
See application file for complete search history.

(56) References Cited

U.S. PATENT DOCUMENTS

| | | | | | |
|---|---|---|---|---|---|
| 671,596 | A * | 4/1901 | Himmelwright | E04B 5/29 | 52/326 |
| 675,487 | A * | 6/1901 | Kunneke | E04B 5/29 | 52/326 |
| 1,938,887 | A | 12/1933 | Young | | |
| 1,970,309 | A * | 8/1934 | Hoyer | E04B 5/29 | 52/434 |
| 2,028,169 | A | 1/1936 | Sahlberg | | |
| 2,071,378 | A | 2/1937 | Arnn | | |
| 2,382,139 | A * | 8/1945 | Cueni | E04B 5/29 | 264/228 |
| 3,440,793 | A * | 4/1969 | Zehnle | E04B 1/30 | 52/454 |
| 4,196,558 | A * | 4/1980 | Jungbluth | E04C 3/293 | 52/334 |
| 4,363,200 | A * | 12/1982 | Goldenberg | E04C 3/20 | 52/251 |
| 4,571,913 | A | 2/1986 | Schleich et al. | | |
| 4,660,341 | A | 4/1987 | Holtz | | |
| 5,279,093 | A * | 1/1994 | Mead | B28B 7/0044 | 52/834 |
| 5,644,890 | A * | 7/1997 | Koo | E04B 5/43 | 52/223.1 |
| 8,813,445 | B2 * | 8/2014 | Kim | E04B 5/263 | 52/220.1 |
| 2009/0288355 | A1 * | 11/2009 | Platt | E04B 5/23 | 52/223.1 |
| 2012/0124796 | A1 * | 5/2012 | Ibanez Ceba | E04B 5/10 | 29/33 K |
| 2014/0109325 | A1 * | 4/2014 | Han | E01D 2/02 | 14/73 |

FOREIGN PATENT DOCUMENTS

| | | |
|---|---|---|
| KR | 10-2006-0046151 | 5/2006 |
| WO | WO 90/13717 A1 | 11/1990 |

* cited by examiner

*Primary Examiner* — Brian Mattei
(74) *Attorney, Agent, or Firm* — Richard C. Litman

(57) ABSTRACT

The precast I-beam concrete panels include an elongate I-beam embedded in an elongate concrete beam that has a platform or panel parallel to the upper flange of the I-beam. The I-beam is longer than the concrete beam so that opposite end portions of the I-beam project past the corresponding ends of the concrete beam. During installation, the projecting end portions of the I-beam may be seated into corresponding notches or recesses in spaced support beams. The sides of the concrete beam may be flat for abutting engagement with adjacent panels, or may be provided with opposing, stepped lip flanges for forming lap joints along longitudinal edges of adjacent panels. The sides of the precast I-beam concrete panels may be semi-parabolic, so that adjacent panels define an arch below interlocking panels. A plurality of the panels laid side-by-side and supported by the notched beams define a concrete floor or concrete foundation.

6 Claims, 5 Drawing Sheets

PRECAST I-BEAM CONCRETE PANELS

BACKGROUND OF THE INVENTION

1. Field of the Invention

The present invention relates to construction components, and particularly to precast I-beam concrete panels used to build concrete floors or concrete foundations from modular components with reduced labor and costs and substantial savings of time.

2. Description of the Related Art

In building construction, many buildings have a foundation formed from concrete slabs, on which a subfloor of wood is laid, Other buildings may have a concrete floor, e.g., a basement floor, or a concrete floor that supports metal-reinforced concrete walls, such as the types of building described in my co-pending patent application, U.S. patent application Ser. No. 14/663,665, filed Mar. 20, 2015 and entitled "Metal Reinforced Concrete Beam and Metal Reinforced Buildings Incorporating Such Beams." In either case, such concrete foundations or concrete floors are usually made by casting concrete into concrete forms either directly on the ground or supported on piers, finishing the concrete with screeds or the like, and waiting for the concrete to cure. The concrete foundation or floors may be reinforced by some form of rebar, such as bolsters, chairs, etc. The process of laying the concrete foundations and floors by traditional methods is labor intensive and time-consuming.

Thus, precast I-beam concrete panels solving the aforementioned problems are desired.

SUMMARY OF THE INVENTION

The precast I-beam concrete panels include an elongate I-beam embedded in an elongate concrete beam that has a platform or panel parallel to the upper flange of the I-beam. The I-beam is longer than the concrete beam so that opposite end portions of the I-beam project past the corresponding ends of the concrete beam. During installation, the projecting end portions of the I-beam may be seated into corresponding notches or recesses in spaced support beams. The sides of the concrete beam may be flat for abutting engagement with adjacent panels, or may be provided with opposing, stepped lip flanges for forming lap joints along longitudinal edges of adjacent panels. The sides of the precast I-beam concrete panels may be semi-parabolic, so that adjacent panels define an arch below interlocking panels. A plurality of the panels laid side-by-side and supported by the notched beams define a concrete floor or concrete foundation.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
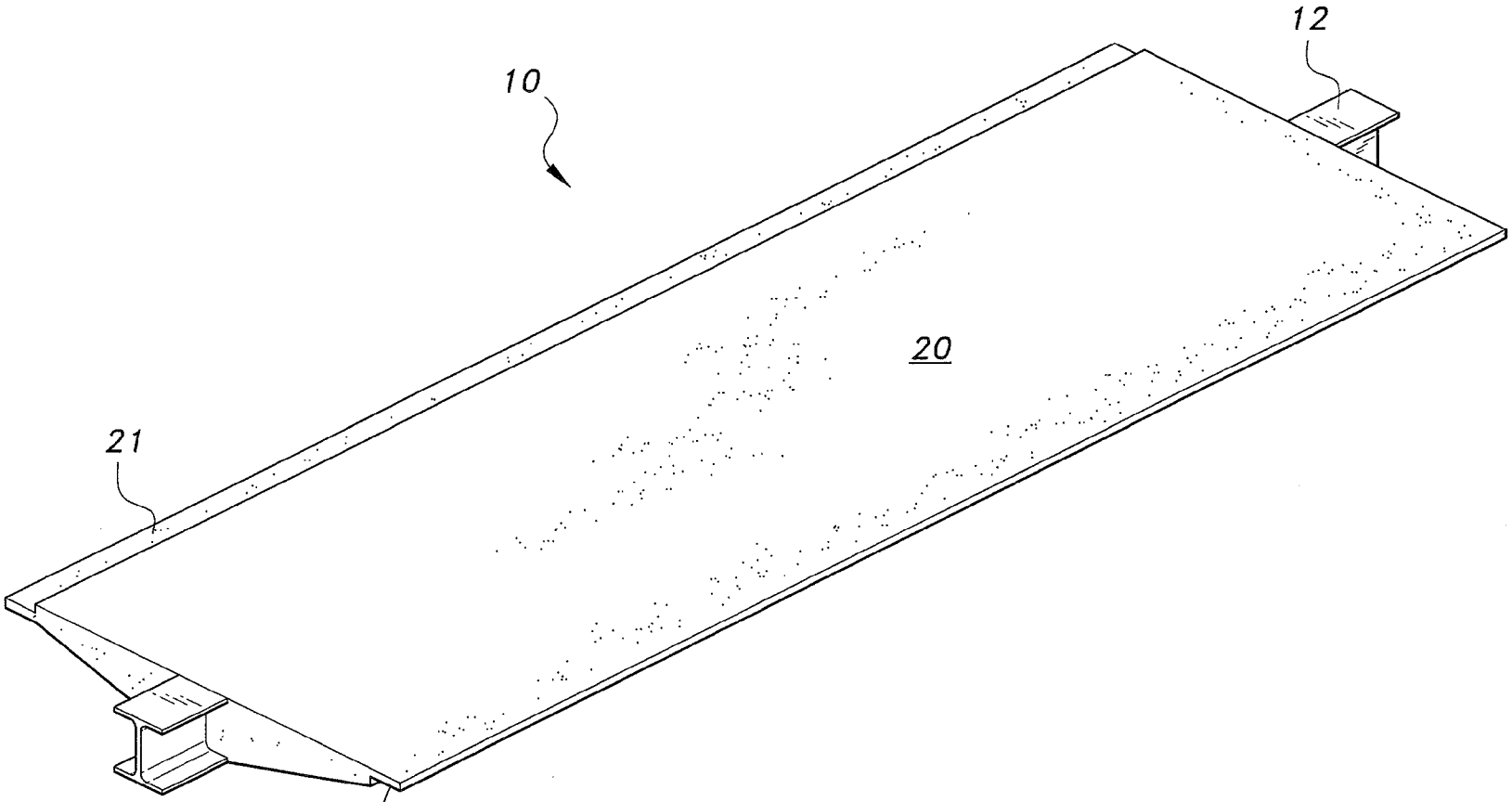
FIG. 1 is a perspective view of a precast I-beam concrete panel according to the present invention.
Figure 2:
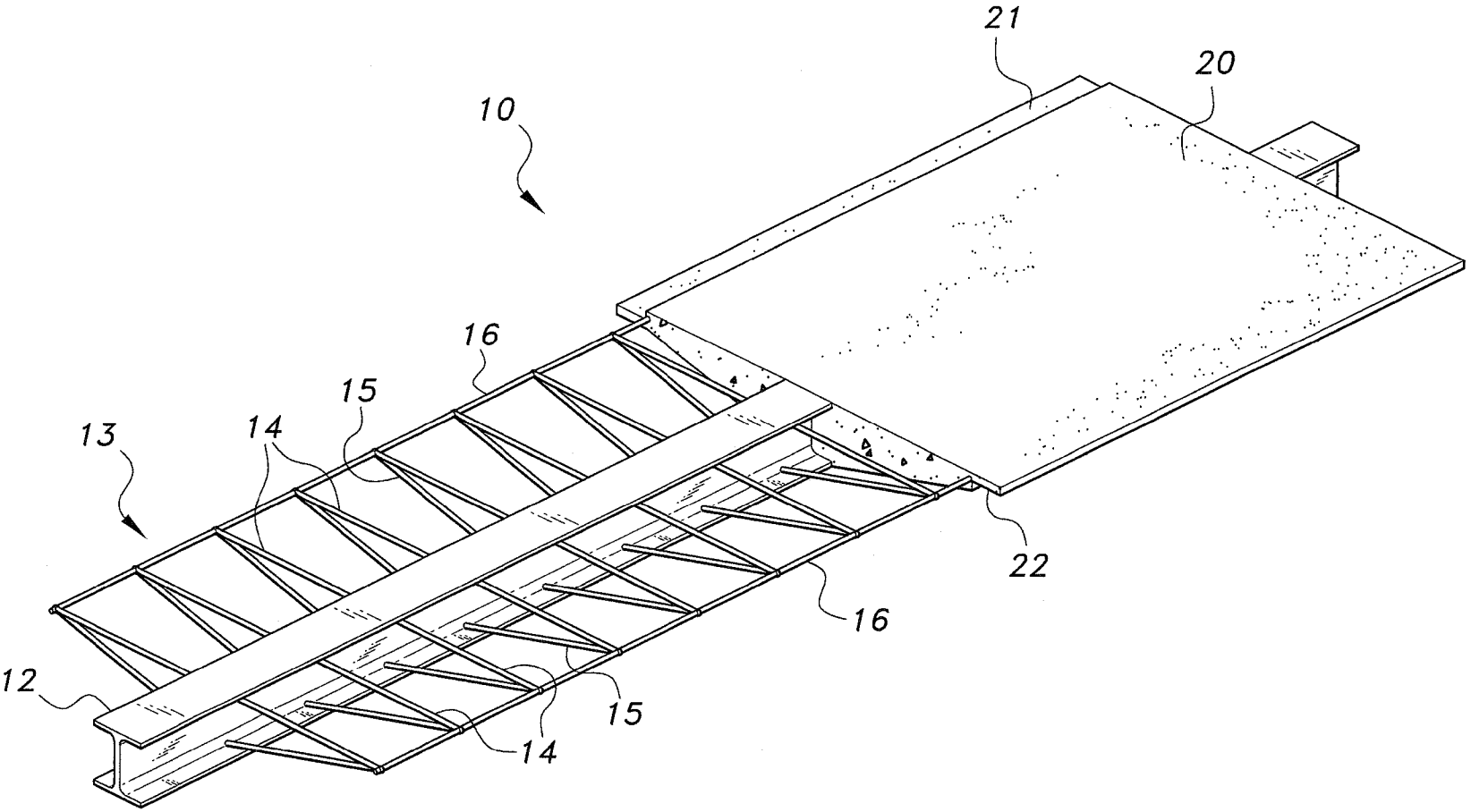
FIG. 2 is a perspective view of the precast I-beam concrete panel of FIG. 1, shown broken away and partially in section to show reinforcing rebar framework for the panel.

The precast I-beam concrete panel, a first embodiment of which is generally referred to by the reference number 10 in the Figures, provides a relatively high degree of bending moment resistance and construction versatility in a low cost manner. As shown in FIGS. 1-4, the precast I-beam concrete panel is an elongate, steel reinforced concrete beam that provides a relatively larger cross-sectional area for resisting bending moments.

The precast I-beam concrete panel 10 includes an elongate I-beam 12, preferably steel, and an elongate reinforcing framework 13 generally defining the cross-sectional shape of the precast I-beam concrete panel 10. The framework 13 includes a plurality of pairs of elongate cross members 14 extending outward from or near opposite lateral sides of the upper flange of the I-beam 12 at spaced intervals along the length of the I-beam 12. The spacing may be regular or irregular, depending on the requirements of the user, and the cross members 14 may extend in opposite directions in a staggered, regular or irregular pattern rather than the regular, collinear pattern shown in FIG. 2. An elongate strut support member 15 extends at an angle from or near the lower flange of the I-beam 12 towards the distal end of each cross member 14 to terminate at an apex and form a generally triangular shape between the vertical web of the I-beam 12, the respective cross member 14, and the respective support member 15. This triangular shape preferably defines a right triangle to form a relatively flat top in the fully formed precast I-beam concrete panel 10. An elongate connecting member 16 is coupled to the vertex between each cross member 14 and support member 15 to interconnect the plurality of vertices one each side of the I-beam 12 and form an elongate, stable triangular frame. The connecting member 16 extends along a parallel length of the I-beam 12 on either side.

The I-beam 12 and the framework 13 form a reinforcing internal frame for the precast I-beam concrete panel 10. A mold (not shown) is built around the I-beam 12 and the framework 13 to pour concrete therein and form an elongate concrete beam 20 encasing the framework 13 and a major length of the I-beam 12. After curing, the concrete beam 20 in the finished precast I-beam concrete panel 10 preferably does not cover the full length of the I-beam 12. Opposite end portions of the I-beam 12 preferably extend or project a predetermined or given length past the opposite ends of the concrete beam 20. Thus the length of the I-beam 12 is longer than the length of the concrete beam 20.

Figure 3:
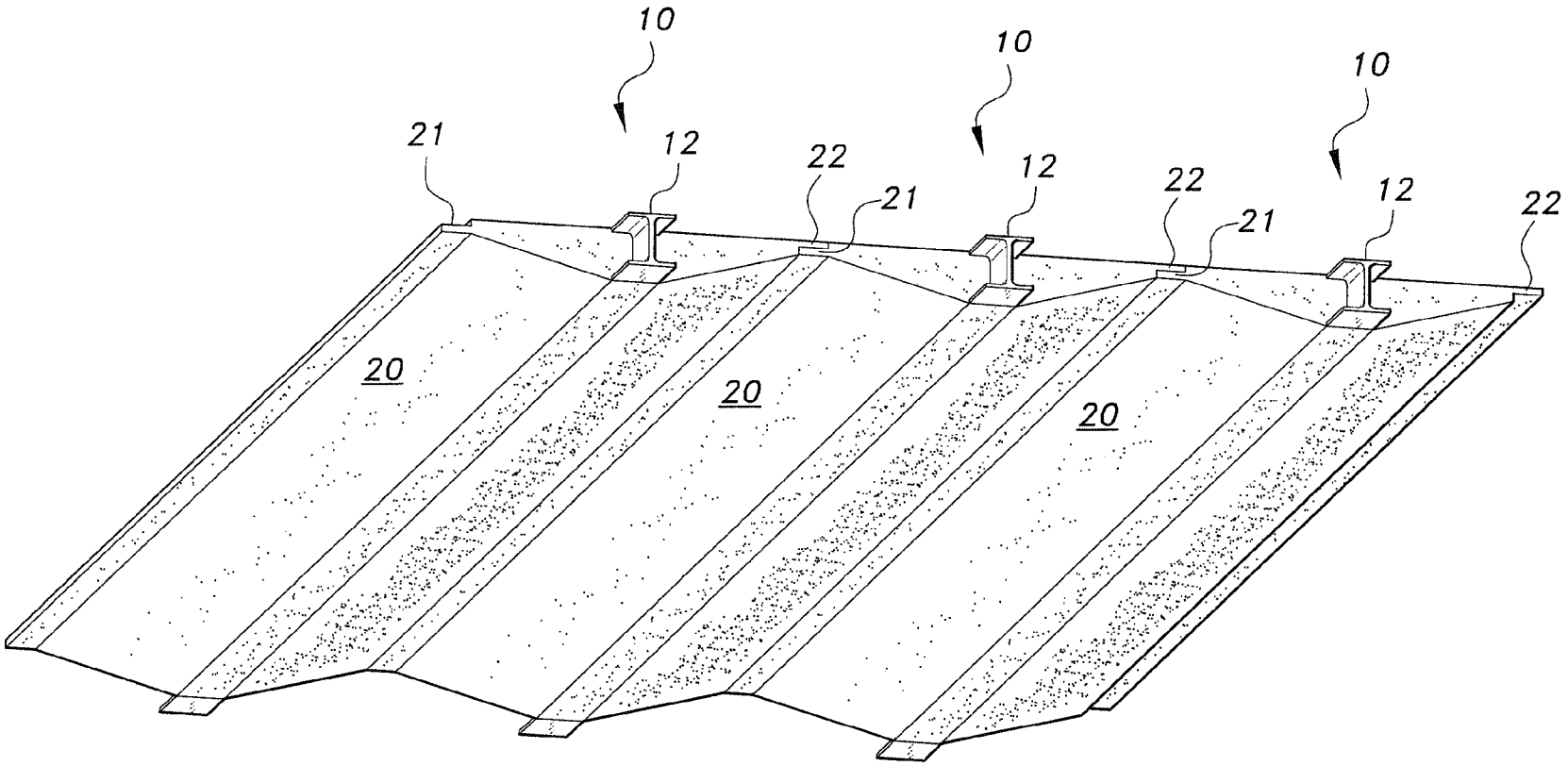
FIG. 3 is a bottom perspective view of a plurality of the precast I-beam concrete panels of FIG. 1 assembled in an interlocking row.

As best seen in FIG. 3, each precast I-beam concrete panel 10 has a generally trapezoidal cross-sectional portion supporting the top panel surface. The relatively large area of the cross section increases the bending resistance of the precast I-beam concrete panel 10, compared to most conventional beams or girders. Moreover, the trapezoidal shape provides a more even counter to any load along the width of the precast I-beam concrete panel 10. For example, any load on the panel 10 is distributed in a bell-curve pattern along the width and length of the panel 10, where, with respect to the width, the magnitude of the load is at a maximum at the center and at a minimum at the lateral sides. There is more area at the center section of the trapezoidal cross-sectional portion to counterbalance and resist the load compared to the lateral sides, which experience minimum magnitude of the load.

Each side of the concrete beam 20 is provided with a respective stepped first lip flange 21 and a stepped second lip flange 22, are oriented in opposite directions from each other. As best seen in FIG. 3, the first lip flange 21 and the second lip flange 22 permit a plurality of precast I-beam concrete panels 10 to be connected in a row forming interlocking seams or joints between adjacent panels 10, forming a lap joint between the panel portion of adjacent or abutting beams 10. Any number of precast I-beam concrete panels 10 of various lengths can be so arranged, depending on the requirements of a particular construction project, e.g., a floor of non-uniform dimensions. Apart from the framework 13, the precast I-beam concrete panel 10 can be easily manufactured and tailored to specific requirements of the construction project with minimal labor and costs.

Figure 4:
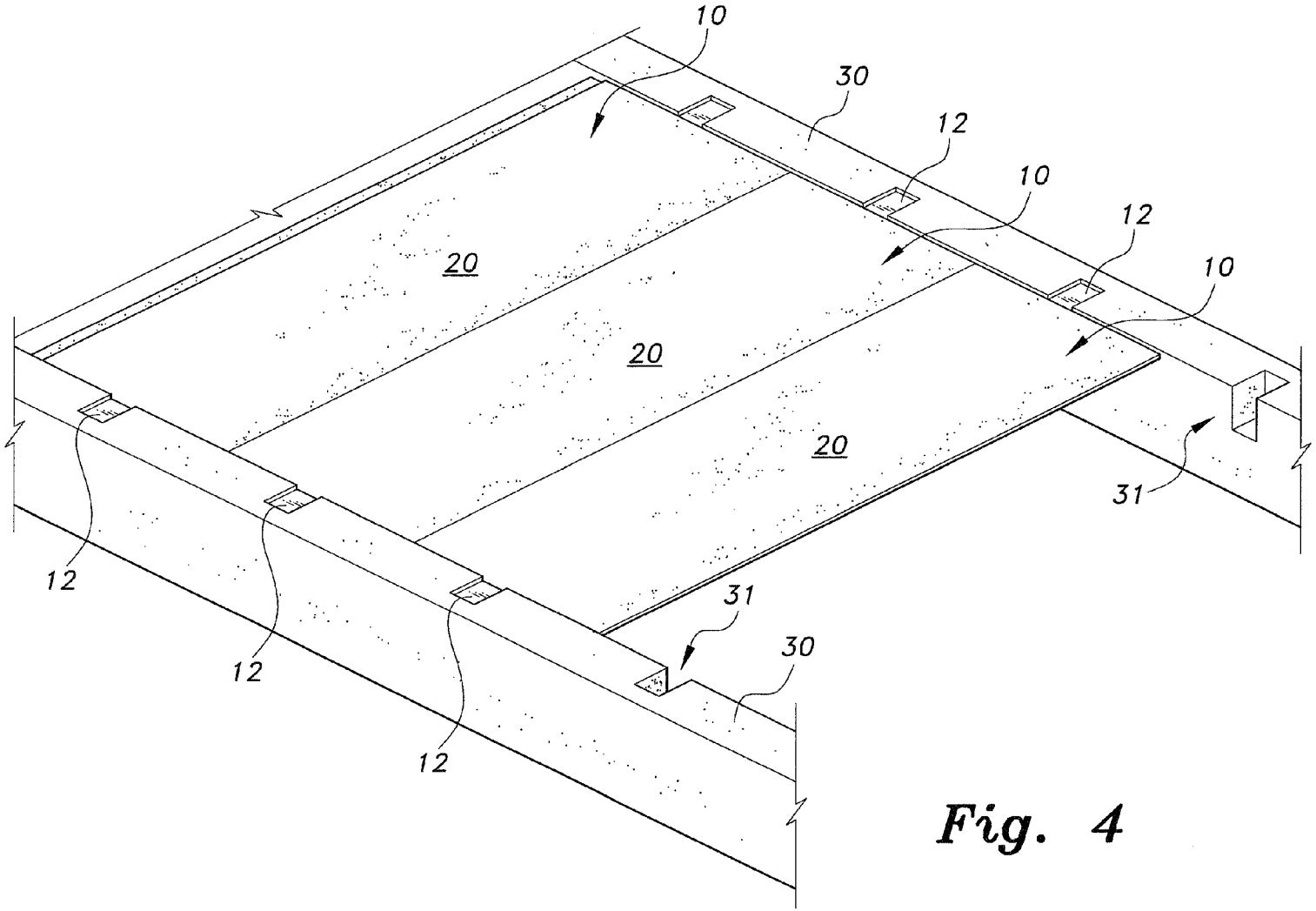
FIG. 4 is a perspective view of the plurality of I-beam concrete panels shown in FIG. 1 assembled between notched support beams to form a floor of a building.

As best seen FIG. 4, the construction of the precast I-beam concrete panels 10 allows for easy installation. For any type of construction project, support beams 30 may be provided with spaced support notches or recesses 31 dimensioned and configured to support the projecting portion of the I-beam 12 therein. Each panel 10 can be easily placed at predetermined locations along the length of the support walls 30 without additional tooling, although the projecting portions of the I-beam 12 may require additional anchoring via fasteners and the like to secure the panels 10.

Figure 5:
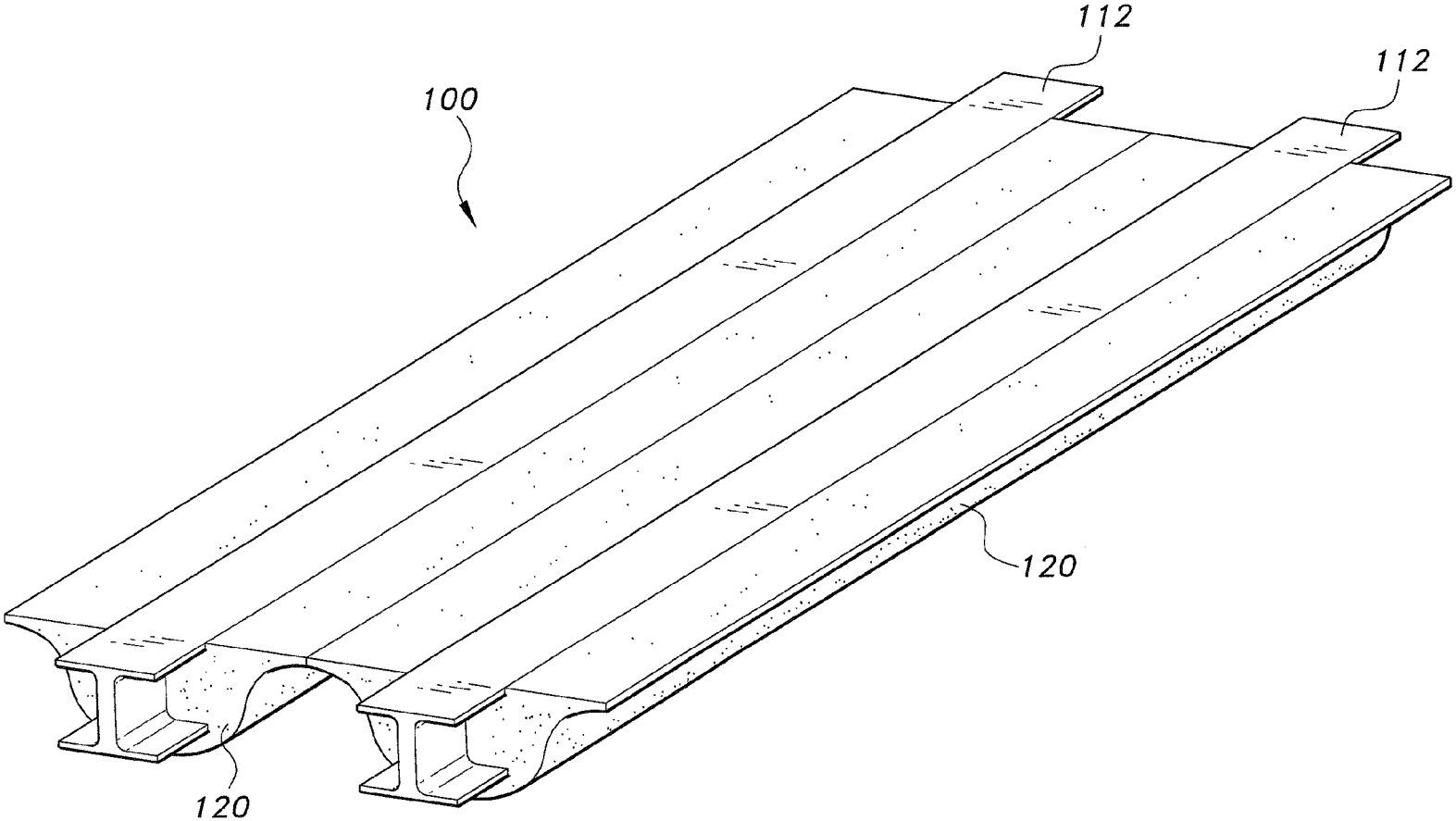
FIG. 5 is a perspective view of another embodiment of precast I-beam concrete panels according to the present invention having arcuate sides.

Another embodiment of a precast I-beam concrete panel 100 is shown in FIG. 5. In this embodiment, an elongate I-beam 112 is embedded in an elongate concrete beam 120 where the cross sectional shape of the precast I-beam concrete panel 100 is a semi-parabolic curve, rather than trapezoidal. The manufacture of the precast I-beam concrete panel 100 may be similar to the I-beam concrete panel 10 with a similar framework 13 to reinforce the panel 100, or without such framework 13. Depending on the specific use environment, the I-beam 112 may not require encasement within the concrete beam 120, as shown in FIG. 4. The semi-parabolic shape of the cross section performs the same function as the trapezoidal shape of the precast I-beam concrete 10, except that the semi-parabolic shape more closely follows a typical load curve along the width of the precast I-beam concrete panel 100 to counterbalance or resist such loads. Moreover, the lateral edges of the panel portion of the concrete beam 120 may be flat instead of stepped to permit the side edges of adjacent panels 100 to abut against each other during installation. As shown in FIG. 5, the semi-parabolic sides of the concrete beam 120 define arches under the abutting or overlapping panel edges of the concrete beam 120, transferring any load placed on the seam between adjacent beans 120 to the lower flange of the I-beam reinforcement.

It is to be understood that the present invention is not limited to the embodiments described above, but encompasses any and all embodiments within the scope of the following claims.

I claim:

1. A precast I-beam concrete panel, comprising:

an elongate I-beam having a length, a top flange, a bottom flange, and a vertical web between the top flange and bottom flange;

a rebar framework mounted to the I-beam, the framework reinforcing the precast I-beam concrete panel, the framework defining the cross-sectional shape and dimensions of the concrete beam;

wherein the rebar framework including:

a plurality of pairs of elongate cross members disposed at spaced intervals along the length of the I-beam, each of the pairs of cross members extending outward from corresponding opposite sides adjacent the top flange of the I-beam;

an elongate strut support member extending at an angle from adjacent the bottom flange towards a distal end of each of the cross members to terminate at a vertex and form a generally triangular shape between the vertical web of the I-beam and the respective cross member; and an elongate connecting member coupled to the vertices along each side of the top flange to interconnect the vertices and form an elongate, stable triangular frame along each side of the I-beam; and an elongate concrete beam having a length shorter than the I-beam, the I-beam and the rebar framework being embedded in the concrete beam, an end portion of the I-beam projecting outward from each of the ends of the concrete beam, each of the end portions of the I-beam being adapted for seating within a recess of a support beam;

wherein the concrete beam having a top width larger than a bottom width, the top width defining a panel portion of the concrete beam, the concrete beam, and the I-beam and the rebar framework embedded within the concrete beam having a cross-sectional shape tapering narrow to wide from the bottom flange towards the top flange, the cross-sectional shape having a first width at the bottom flange and a second width at the top flange, the cross-sectional shape selected from a group consisting of trapezoidal and semi-parabolic area of sufficient size to resist bending along the length and width of the precast I-beam concrete panel;

wherein the cross sectional-shape follows a load curve along the width to facilitate the bending resistance; and wherein the panel portion of the concrete beam having a top surface defining a panel having a width greater than the top flange of the I-beam.

2. The precast I-beam concrete panel according to claim 1, wherein the concrete beam comprises:

a stepped first lip flange extending along one side of the concrete beam; and a stepped second lip flange extending along an opposite side of the concrete beam, the first lip flange and the second lip flange being oriented in opposite directions from each other, the first lip flange and the second lip flange forming lap joint between adjacent precast I-beam concrete panels.

3. The precast I-beam concrete panel according to claim 1, wherein the concrete beam comprises a flat edge on opposing sides of the concrete beam, the flat edge facilitating abutting engagement between adjacent precast I-beam concrete panels.

4. The precast I-beam concrete panel according to claim 1, wherein the concrete beam comprises:

a stepped first lip flange extending along one side of the concrete beam; and a stepped second lip flange extending along an opposite side of the concrete beam, the first lip flange and the second lip flange being oriented in opposite directions from each other, the first lip flange and the second lip flange forming lap joint between adjacent precast I-beam concrete panels.

5. The precast I-beam concrete panel according to claim 1, wherein the concrete beam has a flat edge on opposing sides of the concrete beam, the flat edge facilitating abutting engagement between adjacent precast I-beam concrete panels.

6. A precast concrete flooring system, comprising:

a plurality of precast I-beam concrete panels according to claim 1; and a pair of concrete support beams, each of the beams having spaced apart notches defined therein, the notches being dimensioned and configured to receive the projecting ends of the I-beams, whereby the precast I-beam concrete panels may be supported on the concrete support beams with the top surface panels abutting to define a flooring surface.

* * * * *